US008555531B2

(12) United States Patent
Verstraelen et al.

(10) Patent No.: US 8,555,531 B2
(45) Date of Patent: Oct. 15, 2013

(54) SYSTEM AND METHOD FOR OPTIMIZING DREDGING

(75) Inventors: Luk Verstraelen, Vossem (BE); Lucien Halleux, Spa (BE); Stefaan Vandycke, Bredene (BE)

(73) Assignee: Dredging International N.V., Zwijndrecht (BE)

( * ) Notice: Subject to any disclaimer, the term of this patent is extended or adjusted under 35 U.S.C. 154(b) by 525 days.

(21) Appl. No.: 12/677,862

(22) PCT Filed: Sep. 11, 2008

(86) PCT No.: PCT/EP2008/062058

§ 371 (c)(1),
(2), (4) Date: Mar. 12, 2010

(87) PCT Pub. No.: WO2009/034129

PCT Pub. Date: Mar. 19, 2009

(65) Prior Publication Data

US 2010/0299970 A1 Dec. 2, 2010

(30) Foreign Application Priority Data

Sep. 13, 2007 (EP) ..... 07116286

(51) Int. Cl.
*E02F 3/76* (2006.01)

(52) U.S. Cl.
USPC ..... 37/308

(58) Field of Classification Search
USPC ..... 37/308, 318, 320, 321, 323; 405/52, 53, 405/55, 59, 195, 210; 175/50
See application file for complete search history.

(56) References Cited

U.S. PATENT DOCUMENTS

| | | | |
|---|---|---|---|
| 3,645,018 | A | 2/1972 | De Koning et al. |
| 4,345,388 | A | 8/1982 | de Keizer |
| 4,955,437 | A | 9/1990 | Bohman |
| 5,428,908 | A | 7/1995 | Kerfoot |
| 2002/0063652 | A1 | 5/2002 | Price |
| 2003/0009286 | A1 | 1/2003 | Shibusawa et al. |
| 2004/0168358 | A1 | 9/2004 | Stump |
| 2006/0090379 | A1 | 5/2006 | Furem |
| 2007/0153627 | A1 | 7/2007 | Tulett et al. |

FOREIGN PATENT DOCUMENTS

| | | | |
|---|---|---|---|
| DE | 4336057 | | 1/1995 |
| GB | 1429413 | | 3/1976 |
| GB | 2 048 990 | A | 12/1980 |
| WO | 2004/106643 | A2 | 12/2004 |
| WO | 2005/103396 | A1 | 11/2005 |

*Primary Examiner* — Robert Pezzuto
(74) *Attorney, Agent, or Firm* — Novak Druce Connolly Bove + Quigg LLP

(57) ABSTRACT

A system for optimizing the dredging of an area by a vessel (25) equipped with a cutter head (4), including an apparatus to measure local seismic velocity in front of the vessel (25), said apparatus including a set of seismic receivers (11, 11', 11", 11'") supported by a frame (10) configured for attachment to and projection from the bow end of the vessel, which frame aligns the seismic receivers (11, 11', 11", 11'") above and in front of the cutter head (4). A method for optimizing dredging.

23 Claims, 3 Drawing Sheets

SYSTEM AND METHOD FOR OPTIMIZING DREDGING

CROSS-REFERENCE TO RELATED APPLICATIONS

Figure 1:
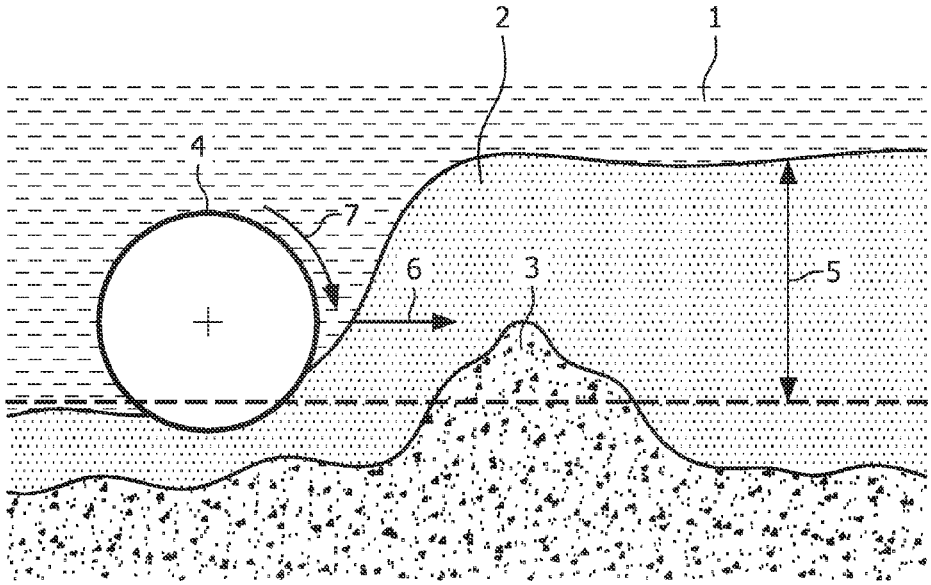

This application is a §371 national stage entry of International Application No. PCT/EP2008/062058, filed Sep. 11, 2008, which claims priority to European Patent Application No. 07116286.1, filed Sep. 13, 2007, both of which are hereby incorporated by reference.

BACKGROUND

The last ten years have seen an important increase in the volume of dredging activity, of which an increasing proportion is performed on solid rock. This situation is explained by the increased depth required by marine infrastructure projects and by the geological characteristics of certain regions such as the Persian Gulf. All projections indicate that this tendency of growth will continue in the next decade.

In response to this evolution, dredgers with increasingly powerful cutter heads are operating in construction areas; allowing a higher production rate at a lower cost compared to the traditional drilling and blasting method.

The optimal exploitation of a dredge implies a good geological knowledge of the site. In particular, the position of the rock zones most resistant to cutting must be known because they should be attacked prudently to avoid undue wear and damage to the cutter.

However, in reality, the quality and depth of the rock frequently varies abruptly both in the vertical and horizontal directions. Thus, the cutter head 4 (FIG. 1), can encounter a few meters of loose ground (e.g. sand) 2 followed by a rock 3 more resistant than concrete. In most cases, a document of invitation to tender will give an indication on the geological and geotechnical situ characteristics but it is often insufficient and incomplete. The area of dredging sites is typically a few square kilometers and the distance between exploratory boreholes is typically several hundred meters, whereas shallow rock zones often measure about ten meters only. Such hard spots frequently remain undetected until hit by the cutter head. The simple drilling of additional random boreholes, does not improve the situation.

Traditionally, the dredge master is faced with two possible options:

- trying to use "brute force" to maximize the production output, with a high risk of rupture and thus of frequent stops for unplanned repair;
- avoiding damage to the cutter suction dredge by limiting the cutting power, which involves an unnecessarily low production output in the non-rock zones.

The present invention aims to overcome the problems in the art by providing a system that receives high resolution seismic velocity information on the material in advance of the cutter head, and can provide specific adjustment to the cutting parameters in response there to, optionally in addition to the low resolution information usually already available.

The high resolution information is acquired and updated while dredging. The seismic data can be used to fine tune an existing geological model close by the cutter head, during the dredging process itself via seismic velocity measurements close around and in front of the cutter head.

FIGURE LEGEND

FIG. 1: Schematic illustration of a cross-section of the seabed, showing water layer 1, loose material layer (e.g. sand) 2, rock layer 3, cutter head 4, and depth of dredging under seabed 5. The cutter head 4 rotates 7, and advances 6 into the sand 2 and/or rock 3 layers.

Figure 2:
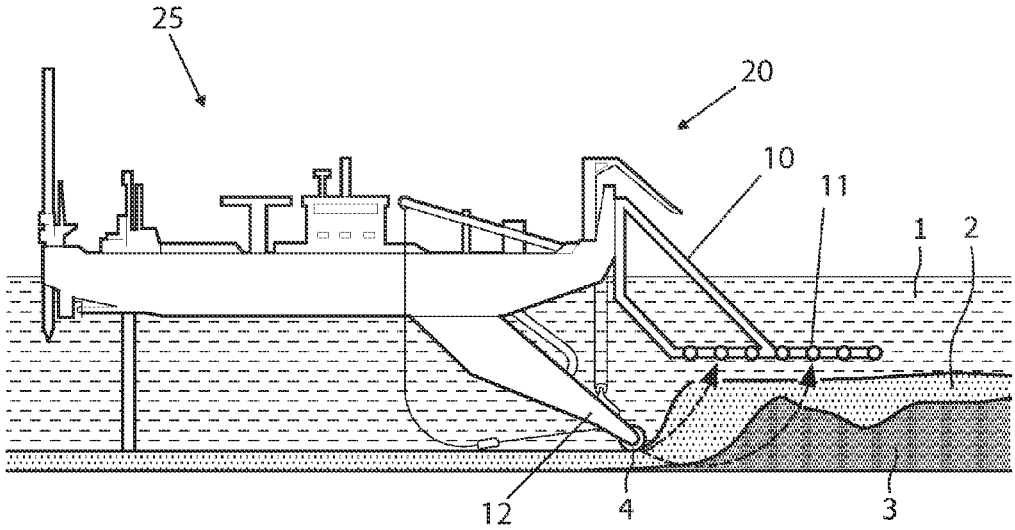

FIG. 2: Schematic illustration of a vessel 25 adapted with a system of the invention, comprising a frame 10 disposed with a plurality of seismic receivers 11 position in the water, in advance of the cutter head 4.

Figure 3:
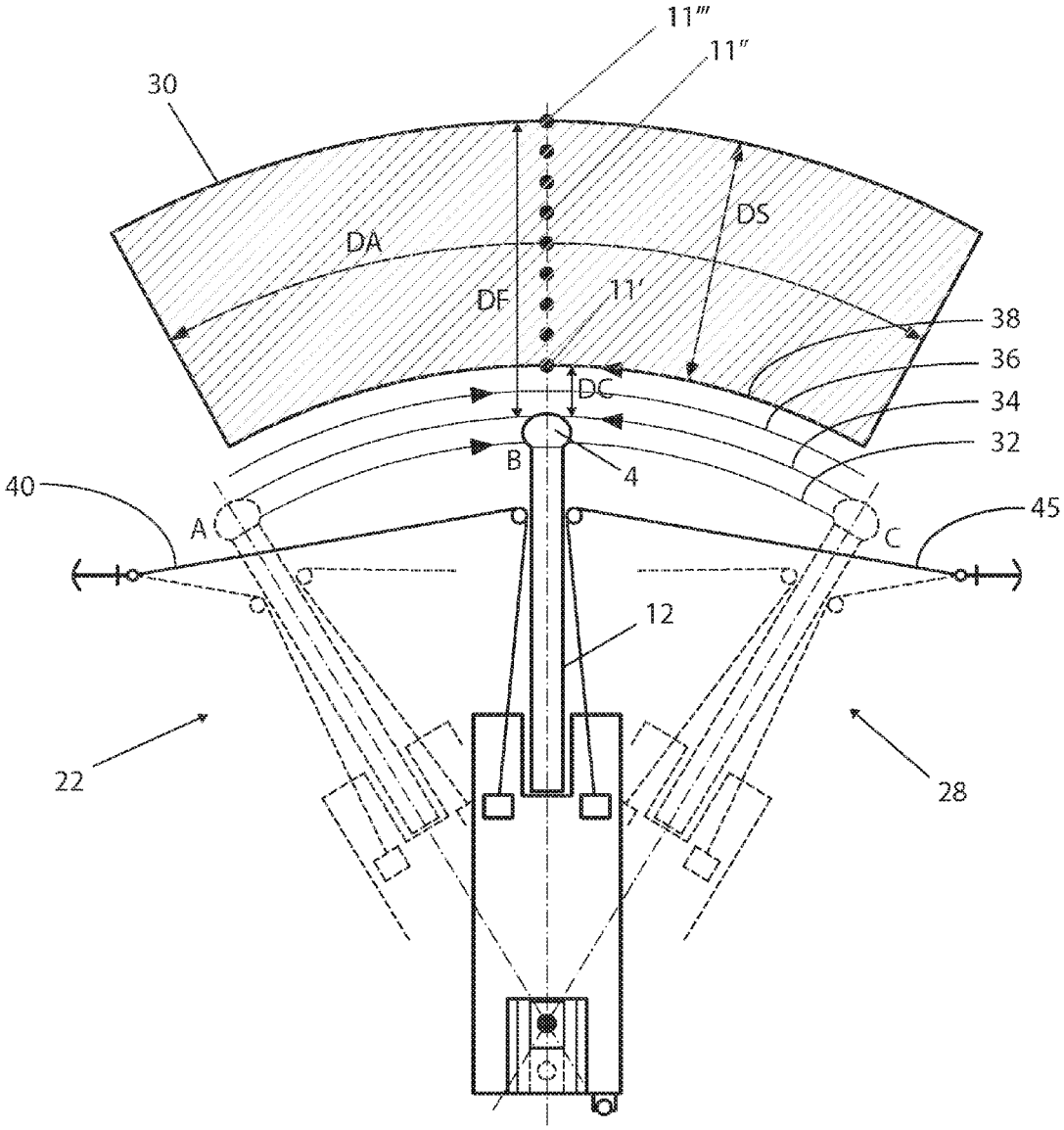

FIG. 3: Schematic illustration of the sweep of the cutter head 4 indicating the position of the seismic receivers 11', 11", 11'''.

Figure 4:
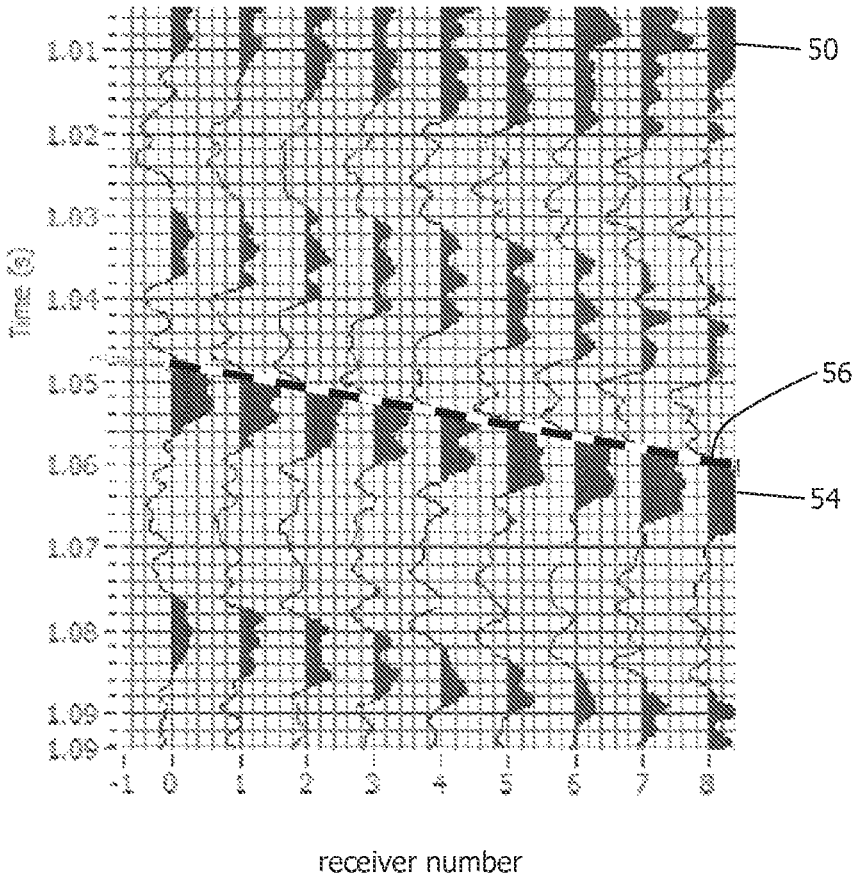

FIG. 4: A trace from a seismograph indicating seismic events recorded over time from each of nine separate seismic receivers (0 to 8).

SUMMARY OF THE INVENTION

One embodiment of the invention is a system for optimizing the dredging of an area by a dredging vessel (25) equipped with a cutter head (4), comprising a means to measure local seismic velocity in front of the vessel (25), said means comprising a set of seismic receivers (11, 11', 11", 11''') supported by a frame (10) configured for attachment to the bow end of the vessel, which frame aligns the seismic receivers (11, 11', 11", 11''') above and in front of the cutter head (4).

Another embodiment of the invention is a system as described above, wherein the frame is adapted to support the set of seismic receivers (11, 11', 11", 11''') in a horizontal line.

Another embodiment of the invention is a system as described above, wherein the set of seismic receivers (11, 11', 11", 11''') comprises at least two hydrophones.

Another embodiment of the invention is a system as described above, wherein the frame is adapted to support the seismic receiver (11') closest to the bow end (20) of the vessel (25) at a horizontal distance of at least 3 m beyond the cutter head (4).

Another embodiment of the invention is a system as described above, wherein the frame is configured for rigid attachment to the vessel.

Another embodiment of the invention is a system as described above, wherein the frame is configured for attachment to the vessel via an articulated joint or a dampening suspension.

Another embodiment of the invention is a system for optimizing the dredging of an area by a vessel (25) equipped with a cutter head (4), comprising a means to measure local seismic velocity in front of the vessel (25), said means comprising a set of seismic receivers (11, 11', 11", 11''') supported by a frame adapted to float in or on water.

Another embodiment of the invention is a system as described above, wherein the frame is adapted to support the set of seismic receivers (11, 11', 11", 11''') in a horizontal line.

Another embodiment of the invention is a system as described above, wherein the set of seismic receivers (11, 11', 11", 11''') comprises at least two hydrophones.

Another embodiment of the invention is a system as described above, wherein the floating frame is provided with a propulsion means to move its position and orientation remotely and independently of the position of the vessel.

Another embodiment of the invention is a system as described above, further comprising:

- a means to receive conventional soil data of the area to be dredged,
- a means to optimize dredging parameters for a current and subsequent cutter head position based on the combination of conventional and local soil information to optimize yield and cutter wear, a means to output dredging parameters, thereby adjusting cutter parameters based on the dredging parameters so giving optimum efficiency at a current and subsequent cutter head position.

Another embodiment of the invention is a method for optimizing, during dredging, the dredging of an area by a vessel (25) equipped with a cutter suction head comprising the steps of:

obtaining conventional soil information of the area to be dredged, measuring one or more local soil parameters that includes local seismic velocity of the soil in front of the cutter head during dredging, calculating dredging parameters for a current and subsequent cutter head position based on the combination of conventional and local soil parameters to optimize yield and cutter wear, and using the dredging parameters so obtained to adjust cutter parameters so giving optimum efficiency at a current and subsequent cutter head position.

Another embodiment of the invention is a method as described above, wherein local soil parameters further comprise geo-resistivity data.

Another embodiment of the invention is a method as described above, wherein local soil parameters further comprise reflection seismics data such as parametric echosounding data or sub bottom profiler data.

Another embodiment of the invention is a method as described above, wherein the local soil parameters further comprise any of vibrational data, sound data, temperature measurements at the cutter head, swing speed of the cutter head.

Another embodiment of the invention is a method as described above, wherein the cutter parameters are any of lateral swing speed, cutter head rotation speed, cutter head rotation torque, attacked layer thickness and width per cut.

Another embodiment of the invention is a method as described above, wherein the geological survey data is obtained from drilling, boreholes, vibrocores, piston sampling, cone penetration testing, and wash probing.

Another embodiment of the invention is a method as described above, wherein a layer thickness and/or layer width attacked and/or lateral swing speed of the cutter are reduced when the proximity of harder soil or rock is measured or expected.

Another embodiment of the invention is a method as described above, wherein a layer thickness and/or layer width attacked and/or lateral swing speed of the cutter are increased when the proximity of softer soil is measured or expected.

DETAILED DESCRIPTION OF THE INVENTION

Unless defined otherwise, all technical and scientific terms used herein have the same meaning as is commonly understood by one of skill in the art. All publications referenced herein are incorporated by reference thereto. The articles "a" and "an" are used herein to refer to one or to more than one, i.e. to at least one of the grammatical object of the article. By way of example, "a sensor" means one sensor or more than one sensor.

The recitation of numerical ranges by endpoints includes all integer numbers and, where appropriate, fractions subsumed within that range (e.g. 1 to 5 can include 1, 2, 3, 4 when referring to, for example, a number of sensors, and can also include 1.5, 2, 2.75 and 3.80, when referring to, for example, measurements). The recitation of end points also includes the end point values themselves (e.g. from 1.0 to 5.0 includes both 1.0 and 5.0).

The present invention is related to the finding by the inventors that it is possible to measure, while dredging soil or rock, the seismic velocity of the soil or rock in front of the cutter, which measurement gives a strong indication on the underwater excavability, hereafter called dredgeability. The measurement can be used in combination with other and conventional soil data to adjust cutter parameters at the cutting site and at a subsequent cutting location. Parameters which can be adjusted are for example the cutter rotation speed, the pulling force on the winches or any other parameter adjusted in order to optimize yield and/or to reduce wear and tear.

One aspect of the invention relates to a method for optimizing, during dredging, the dredging of an area by a vessel, preferably a dredge, equipped with a cutter suction head, comprising:

obtaining conventional soil data of the area to be dredged, measuring one or more local soil parameters that includes local seismic velocity of the soil in front of the cutter head during dredging, calculating dredge parameters for a current and a subsequent cutter head position based on the combination of geological survey data and local soil parameters acquired while dredging to optimize yield and cutter wear, and adjusting cutter parameters in order to optimize production output at a current and subsequent cutter head position.

The vessel is preferably a dredge, and the cutter head itself generates vibrations which propagate into the surroundings. In particular, vibrations which are generated by the cutter head propagate through the soil, rock and water. While dredging, the signals from the seismic receivers placed in front of the cutter head are recorded and are used to calculate dredging parameters for a current and a subsequent cutter head position based on the combination of geological survey data and seismic velocity acquired while dredging to optimize yield and cutter wear.

The seismic velocity (P wave and/or S wave velocity) is a measured local soil parameter relating to the geotechnical characteristics of a rock or soil mass, and is preferably measured via a seismic refraction survey. Seismic velocity designates the velocity of propagation of a seismic wave in the ground. Either compressive seismic waves (P waves) or shear seismic waves (S waves) or interface (surface) waves may be used. The corresponding seismic velocities are designated as P wave velocity and S wave velocity.

Conventional soil data designates all information obtained about the soil or rock properties by using conventional sources or investigation methods independently of the dredging operations; examples are: geological data from maps and publications, borehole descriptions, geotechnical testing reports, geophysical surveys, etc.

Seismic velocity is measured in advance of or in front the cutter head, i.e. it is measured of the undredged soil ahead of the cutter head. It is normally measured by way of a set of seismic receivers supported by a frame projecting beyond the bow end of the vessel. The frame submerges the seismic receivers, and places them above the seabed and ahead of the cutter head.

Besides, seismic velocity, other soil parameters measured in the vicinity of the current position of the cutter head may be used to adjust cutter parameters at the cutting site and at a subsequent cutting location. These include those that can be measured using any in situ technique (e.g. geo-resistivity survey, seismic reflection survey (parametric echosounding survey, sub bottom profiler, etc. . . . ))

Secondary soil related parameters can be employed in the analysis to provide more accuracy. These include vibrational data, sound data, temperature measurements at the cutter head and swing speed of the cutter head. It is within the scope of the invention to use the seismic signals generated by the dredging operation itself to study the soil. The signal generated by the dredging operations themselves may be supplemented by an auxiliary seismic source (e.g. air gun, sparker, pinger, boomer, etc) mounted at a suitable location. Generally the measurement in question is acquired by an appropriate sensor. The sensor may be mounted on the dredge itself, laid upon the sea bed or towed using a suitable auxiliary vessel.

The cutter head is generally a wheel or sphere, mounted on its rotational axis by a ladder suspended below the dredging vessel. The direction of the ladder is adjustable in three-dimensions within its sweep range and can, therefore, cut downwards, forwards and laterally. The dredging parameters that are calculated by the present system can be used to adjust one or more of the cutting characteristics (cutter parameters) of the dredging process e.g. lateral swing speed, cutter head rotation speed, cutter head rotation torque, attacked layer thickness and width per cut. The teeth of the cutter are commonly bi-directional but having a lower cutting action in one lateral swing direction (the so called overcutting swing direction) compared with the other (the so called undercutting swing direction). The lateral swing method can be adjusted to, for example, loosen sand and soft clay in the low-impact overcutting direction, and to cut rock in the high-impact undercutting direction.

The geological survey data may be any obtained by methods generally known to the skilled person. For example, it may be that obtained from geological maps geological literature, or from site-specific drilling.

The method may provide a soil image, that is made available to the dredge master via a Soil Viewer computer display. Based on this information and in full automatic dredging mode, it is the dredge computer itself that will translate this geological information in optimum dredging parameters for the purpose of maximizing the performance of the dredge in a so called self learning process.

As used herein, terms such as "in front", "in advance", "ahead", "beyond" are used to indicate the position of the seismic receivers 11 relative to the cutter head 4 and means that the receivers 11 project horizontally further from the bow end of the vessel than the cutter head 4. Preferably, at least the seismic receivers 11 closest to the vessel project horizontally further from the bow end of the vessel than the cutter head.

System

One aspect of the invention is a system for optimizing the dredging of an area by a vessel 25 equipped with a cutter head 4, comprising a means to measure local seismic velocity in front of the vessel 25, said means comprising:

a set of seismic receivers 11, 11', 11", 11'" supported by a frame 10 configured for attachment to the bow end of the vessel, which aligns the seismic receivers 11, 11', 11", 11'" above and in front of the cutter head 4.

The features defined above in respect of the method apply also to the system.

According to one aspect of the invention, and with reference to FIG. 2 the means to measure local seismic velocity comprises a set of seismic receivers 11, 11' supported by a frame 10 projecting beyond the bow end 20 of the vessel 25. The frame may be rigid as shown in FIG. 2. The frame 10 submerges the seismic receivers 11, 11', and places them above and in advance of the cutter head 4. The frame 10 is preferably attached to the bow end 20 of the vessel, for example to the hull or to the deck or any other structure of the ship. The frame may be rigidly attached directly thereto using, for example, bolts or clips that prevent substantial movement. Alternatively, the frame may be attached using a (moveable i.e. articulated) joint such as a hinge joint, or universal joint that permits limited movement by the frame relative to the vessel. It will be appreciated that the attachment may include a dampening suspension that reduces vibrations transmitted from the vessel to the device and also buffers the vessel from forces applied to the frame by movements of the vessel through the water. Movements by the frame owing to the suspension system and/or joint and which affect subsequent calculations may be corrected using a compensation system that measures the degree of movement by the frame. The frame is constructed to withstand forces applied during movement of the vessel through water, and, as such, will typically have mesh structure that provides strength while at the same time is light and exhibits low drag. Suitable material for the frame include iron, steel, aluminum, glass or carbon fiber.

In an alternative embodiment of the invention, the frame may comprise a single wire (not illustrated). The wire is configured for attachment to the bow end of the vessel, and onto which the seismic receivers are attached in a line. The wire extends from the bow end of the vessel, and below the waterlevel. The end of the wire farthest from the vessel may optionally be disposed with a float adapted to regulate the depth at which said end lies below the water level. The wire may be rigid, being formed preferably from wire (primarily steel) rope, and having a diameter equal to or at least 1 cm, 2 cm, 3 cm, 4 cm, 5 cm, 6 cm or a value in the range between any two of the aforementioned values.

A seismic receiver 11 may comprise a hydrophone, geophone or any other device able to detect and measure displacements or pressure variations related to the seismic signal; preferably hydrophones are employed.

The seismic receiver 11 may be arranged in a straight line as shown in FIGS. 2 and 3, alternatively, may be offset in whichever way deemed convenient for operations. For example, they may be arranged in any one, two or three dimensional pattern.

Another embodiment of the invention is a system for optimizing the dredging of an area by a vessel 25 equipped with a cutter head 4, comprising a means to measure local seismic velocity in front of the vessel 25, said means comprising a set of seismic receivers 11, 11', 11", 11'" supported by a floating frame. The floating frame is supported on or below the water by one or more floats that controls the level of the frame in the water. The frame is positioned above and in front of the cutter head (4). The frame may have mesh structure as described above, that provides strength while at the same time is light and exhibits low drag. Suitable material for such frame include iron, steel, aluminum, glass or carbon fiber. Alternatively, the frame may comprise a wire onto which the seismic receivers are attached in a line. The floating frame may be provided with a propulsion means to move its position and orientation remotely and independently of the position of the vessel. The propulsion means includes one or more motorized propellers. The remote control may be achieved by using cables or a wireless link. The position of the floating frame can be accurately determined for example, using local triangulation e.g. by detection of a marker on the frame by two camera located on the vessel, or using a Global Navigation Satellite System (e.g. GPS) Being independent of the vessel permits the floating frame to change location and orientation responsive to seismic data. This enables the system to obtain signal from a larger region, or to obtain more detailed information of a smaller region relative to the position of the cutter head 4.

The shape of the frame is configured so that set seismic receivers 11 extend from the bow end of the vessel horizontally, so that they can receive signals over an area of the sea bed in front of the vessel. The seismic receivers 11 are preferably directed in a downward position in order to detect signals arising from the sea bed. Typically, depending on the shape of the frame, they will occupy a line or plane that is parallel to the horizon. Other arrangements are within the scope of the invention, however. For example one or more receivers may be located above or below the line or plane. Alternatively, or in addition, the line/plane may be inclined to the horizon, for example, by 1, 5, 10, 15, 20, 25, 30, 35, 40 deg, preferably between 0 and 10 deg.

The seismic receivers 11 may transmit data to a data acquisition unit for processing. Data transmission of the signals may be analog or digital. They may pass through conventional electrical cables, optical cables or use telemetry (e.g. analogue radio, digital radio, infrared, ultrasounds) of any kind.

The number of seismic receivers 11 will depend on the resolution required, and on the region in advance of the cutter needed to be measured. Typically, the number of receivers will be between 3 to 30, preferably between 5 and 15.

With reference to FIG. 3, the system may be configured such that the minimum horizontal distance, DC, between the cutter head 4 and the seismic receiver 11' closest to the bow-end may be less than 1 m, 2 m, 3 m, 4 m, 5 m, or a value in a range between any two of the aforementioned values. The system may be configured such that the minimum horizontal distance, DF, between the cutter head 4 and the seismic receiver farthest 11''' from the bow-end may be at least or equal to 1 m, 2 m, 3 m, 4 m, 5 m, 6 m or a value in a range between any two of the aforementioned values. The skilled person will appreciate that the more seismic receivers 11 present, and the greater horizontal distance, DS, they occupy, the better the coverage of the soil. The system may be configured such that the minimum vertical distance between the cutter head and the seismic receiver 11 may be at least or equal to 1 m, 2 m, 3 m, 4 m, 5 m, 6 m or a value in a range between any two of the aforementioned values. Shown in FIG. 3 is the maximum region 30 that the seismic receiver 11''' detects in advance of the cutter head 4 which is an arc of length DA covering a distance of DS. The value of DA—equal to the sweep distance of the cutter head 4—may be at least or equal to 2 m, 3 m, 4 m, 5 m, 6 m or a value in a range between any two of the aforementioned values. The skilled person will appreciate that the foregoing measurements are for general guidance only. It is within the scope of the invention that values of DC, DF, DA and DS are employed outside the above mentioned ranges, depending upon parameters for example, the vessel, cutting depth, cutting thickness, required resolution, coverage and overlap.

Signals obtained from the seismic receivers 11 may be sent to a data acquisition unit. The unit may be a micro processing device (e.g. a PC or embedded system) with an acquisition component, that converts the signals into digital data, stores it, and allows other devices to retrieve the data. Typically, there will be one channel per seismic sensor. The signals may be displayed on a seismograph or any other device able to retrieve and store the seismic data from the receivers.

The data is preferably processed, which aims at transforming the seismic information into information about the distribution of the seismic velocity and about the geometry of the ground ahead of the cutter head. The processing may be carried out manually, automatically or a combination of both. All the characteristics of the seismic signals, in the time domain and/or in the frequency domain may be used in the processing.

The cutter head 4 extends from the bow end 20 of the ship's hull via an arm 12. The arm 12 is attached to the vessel using a joint, configured allow the cutter head 4 to move not only up and down, but also side to side; FIG. 3 depicts the arm 12 in a port side (A), in a central (B) and in a starboard position (C), which positions are in part controlled by a port side winch cable 40, and a starboard winch cable 45. During cutting, the arm 12 swings in an arc from the portside 22 to the starboard side 28 of the vessel, (direction of 32) and then from the starboard side 28 to the port side 22 of the vessel (direction of 34). Successive arc lines 32, 34, 36, 38 illustrate the forward progress by the cutter head 4 as the vessel advances forward and simultaneously the arm 12 swings from side to side. While the foregoing description describes cutting as commencing from the port side 22 position, this is not intended to be limiting; it will be appreciated that it may start from any position.

Depending upon the signals and the local conditions, one or more processing techniques may be used to improve the signal/noise ratio and to obtain information about the characteristics of the ground. These techniques may be based on existing software and procedures, or specifically developed. These techniques may include, amongst others: Picking of arrivals, Frequency analysis, F-K analysis, Cross correlation, Filtering, Deconvolution, Direct modeling, Inverse modeling, Tomographic processing etc. The zone where data is collected has an azimuthal length depending upon the swing length and a radial length depending upon the length of the receiver array. In general, the radial length is much larger than the step length of the cutter operation (typically 1-2 m). There is, thus, an overlap between the information obtained during successive swings. The overlapping may be used to further improve the processing. The processing may use data obtained from additional sources as mentioned above (e.g. controlled seismic source) and/or additional receivers (e.g. close to the cutter head or on the vessel). Pre-existing geological or geotechnical data may also be used.

Another embodiment of the invention aspect of the invention is a system as described above, further comprising:

- a means to receive conventional soil data of the area to be dredged,
- a means to optimize dredging parameters for a current and subsequent cutter head position based on the combination of conventional and local soil information to optimize yield and cutter wear,
- a means to output cutter parameters, thereby adjusting the cutter parameters so giving optimum efficiency at a current and subsequent cutter head position.

The features defined above in respect of the method apply also to the system.

According to one aspect of the invention, the local soil parameters including seismic velocity data are outputted on a display of a map which shows the current position of the cutter. The map may be provided with levels (e.g. colours, contour lines, . . . ) indicating the optimum cutting parameters. This might be a function of the seismic velocity data optionally combined with one or more geophysical parameters measured during the cutting process. From the display, and in manual dredge mode, the Dredge Master can determine the most appropriate cutter parameters to optimize the dredging. As the cutter head approaches a harder zone, (e.g. high seismic speed and/or high resistivity), the Dredge Master can reduce the pulling force on the sidewinch, and thus the lateral swing speed in order to approach the hard spots carefully. As soon as the hard zone is passed, the pulling force is increased, and thus the lateral swing speed, in order to return to a maximum production output. In automatic dredge mode, the cutter computer itself on board of the cutter suction dredge will translate the gathered geological information into optimum dredging parameters. The invention is not limited to the use of seismic velocity or geo-resistivity or any other parameters or a combination of parameters, as may be justified for a particular dredging project.

The present invention advantageously provides a means to determine the optimum dredging regime with reliance on survey maps or boreholes which have too low resolution to allow fine control and optimal wear and yield parameters. The use of seismic velocity increases yield and efficiency; currently the profit of aggregate output on building site is estimated at least 10%. The system allows a fine and fast geological survey of the soil which data can be used to build maps.

EXAMPLES

An embodiment of the invention is exemplified by the following non-limiting example.

A dredging vessel was fitted with a frame at the bow end disposed with nine seismic sensors, positioned in front of the cutter head and below the water level. The spacing between sensors is 2.5 meters. During cutting, signals from each sensor numbered 0 to 8, were recorded using a seismograph as shown in FIG. 4. In FIG. 4, the vertical scale is time, and the horizontal scale shows the amplitude of the seismic signal. The signal from each receiver is displayed, showing specific features called "events" 50, 54. The succession of events is determined by the cutting process (e.g. stop and start of rotation of the cutter head or changing interaction between cutter head and ground). It can be seen that the signals from all the receivers exhibit quite similar events 50, 54, but with a time shift from trace to trace. The time shift is due to the time it takes for the signals to propagate. The situation shown in FIG. 4 shows a straight and linear connection between the events i.e. the time shift is nearly the same between all receivers, because the ground conditions are homogeneous. By measuring the time shift and knowing the distance between the cutter head and the receivers, the propagation velocity can be measured. For example, dashed line 56 corresponds to a propagation velocity of 1700 m/s.

If the geometry is more complex, as shown in FIG. 2 where sediment and rock is present, the records will show more complex patterns of time shifts. Moreover various types of seismic signals may be present (P waves, S waves, interface waves). It is also possible that seismic signals from another origin than the cutter head be present. Such signals may either be generated by other vibration sources, or in a controlled way by a seismic source being part of the device.

The invention claimed is:

1. A system for optimizing the dredging of an area by a dredging vessel equipped with a cutter head, comprising a means to measure local seismic velocity in front of the vessel, the seismic velocity being defined as the velocity of propagation of a seismic wave in the ground, said seismic wave being generated by the cutter head when moving over the ground, said means comprising a set of seismic receivers supported by a frame configured for attachment to a bow end of the vessel, which frame aligns the seismic receivers above and in front of the cutter head.

2. A system according to claim 1, wherein the frame is adapted to support the set of seismic receivers in a horizontal line.

3. A system according to claim 1, wherein the set of seismic receivers comprises at least two hydrophones.

4. A system according to claim 1, wherein the frame is adapted to support the seismic receiver closest to the bow end of the vessel at a horizontal distance of at least 3 m beyond the cutter head.

5. A system according to claim 1, wherein the frame is configured for rigid attachment to the vessel.

6. A system according to claim 1, wherein the frame is configured for attachment to the vessel via an articulated joint.

7. A system according to claim 1, wherein the frame is configured for attachment to the vessel via a dampening suspension.

8. A system for optimizing the dredging of an area by a vessel equipped with a cutter head, comprising a means to measure local seismic velocity in front of the vessel, said means comprising a set of seismic receivers supported by a frame adapted to float in or on water; and further comprising: a means to receive conventional soil data of the area to be dredged; a means to optimize dredging parameters for a current and subsequent cutter head position based on the combination of conventional and local soil information to optimize yield and cutter wear; and a means to output dredging parameters, thereby adjusting cutter parameters based on the dredging parameters so giving optimum efficiency at a current and a subsequent cutter head position.

9. A system according to claim 8, wherein the frame is adapted to support the set of seismic receivers in a horizontal line.

10. A system according to claim 8, wherein the floating frame is provided with a propulsion means to move its position and orientation remotely and independently of the position of the vessel.

11. A method for optimizing, during dredging, the dredging of an area by a vessel equipped with a cutter suction head comprising the steps of:

translating the cutter suction head across the area, obtaining conventional soil information of the area to be dredged;

measuring one or more local soil parameters that includes local seismic velocity of the soil in front of the cutter head during dredging, the seismic velocity being defined as the velocity of propagation of a seismic wave in the ground, said seismic wave being generated by the cutter head when translating across the area;

calculating dredging parameters for a current and subsequent cutter head position based on the combination of conventional and local soil parameters to optimize yield and cutter wear; and using the dredging parameters so obtained to adjust cutter parameters so giving optimum efficiency at a current and subsequent cutter head position.

12. A method according to claim 11, wherein local soil parameters further comprise geo-resistivity data.

13. A method according to claim 11, wherein local soil parameters further comprise reflection seismic data comprising parametric echo sounding data.

14. A method according to claim 11, wherein local soil parameters further comprise reflection seismic data comprising sub bottom profiler data.

15. A method according to claim 11, wherein the local soil parameters further comprise any of vibrational data, sound data, temperature measurements at the cutter head, swing speed of the cutter head.

16. A method according to claim 11, wherein the cutter parameters are any of lateral swing speed, cutter head rotation speed, cutter head rotation torque, attacked layer thickness and width per cut.

17. A method according to claim 11, wherein the geological survey data is obtained from drilling, boreholes, vibrocores, piston sampling, cone penetration testing, and wash probing.

18. A method according to claim 11, wherein a layer thickness wherein at least one of a layer thickness, a layer width attacked and lateral swing speed of the cutter are reduced when the proximity of harder soil or rock is measured or expected.

19. A method according to claim 11, wherein a layer thickness wherein at least one of a layer thickness, a layer width attacked and lateral swing speed of the cutter are increased when the proximity of softer soil is measured or expected.

20. A system for optimizing the dredging of an area by a dredging vessel, the system comprising:

a rotatable cutter head comprising a plurality of teeth for dredging a ground area, wherein the cutter head is suspended below the dredging vessel and mounted on its rotational axis to a support structure allowing controlled movement of the cutter head in three dimensions to enable cutting in a downward direction, a forward direction, and in a lateral direction;

a set of seismic receivers to measure local seismic velocity in front of the vessel, the seismic velocity being defined as the velocity of propagation of a seismic wave in the ground, said seismic wave being generated by the cutter head when moving over the ground, said set of seismic receivers supported by a frame proximate to a bow end of the vessel, which frame aligns the seismic receivers above and in front of the cutter head; and a dredge computer configured to adjust at least one of rotation speed and movement direction of the cutting head based on the measured local seismic velocity.

21. The system according to claim 20, wherein the frame is a floating frame, comprising a propulsion means to move the floating frame remotely and independently of the position of the vessel.

22. The system according to claim 20, wherein the local seismic velocity is displayed to a human operator who controls the dredge computer.

23. The system according to claim 20, wherein the dredge computer is configured to automatically adjust at least one of rotation speed and movement direction of the cutting head based on the measured local seismic velocity.

* * * * *